US006729593B2

(12) United States Patent
Kanen

(10) Patent No.: US 6,729,593 B2
(45) Date of Patent: May 4, 2004

(54) SUSPENSION ELEMENT AND LUMINAIRE PROVIDED WITH A SUSPENSION ELEMENT

(75) Inventor: Arnoldus Henricus Cornelis Kanen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/280,650

(22) Filed: Oct. 25, 2002

(65) Prior Publication Data

US 2003/0080262 A1 May 1, 2003

(30) Foreign Application Priority Data

Oct. 29, 2001 (EP) ..... 01204102
Jun. 17, 2002 (EP) ..... 02077377

(51) Int. Cl.[7] ..... B42D 13/00
(52) U.S. Cl. ..... 248/343; 362/147; 362/404; 362/406
(58) Field of Search ..... 248/317, 342, 248/343; 362/147, 404, 406, 407, 396

(56) References Cited

U.S. PATENT DOCUMENTS 2,967,692 A * 1/1961 Wolar ..... 248/343
3,323,770 A * 6/1967 Wolar ..... 248/345
3,378,221 A * 4/1968 Wolar et al. ..... 248/343
3,618,176 A * 11/1971 Barnes ..... 248/227.4
4,754,377 A * 6/1988 Wenman ..... 362/148
5,130,914 A * 7/1992 Bengochea ..... 362/364
5,309,342 A * 5/1994 Heinen, Sr. ..... 362/364
5,465,199 A * 11/1995 Bray et al. ..... 362/364
6,003,928 A * 12/1999 Curtindale ..... 296/97.9

FOREIGN PATENT DOCUMENTS

DE 3729276 A1 3/1989 ..... F21V/21/00

* cited by examiner

*Primary Examiner*—Ramon O. Ramirez
*Assistant Examiner*—Amy J. Sterling

(57) ABSTRACT

Suspension element (5) comprising two, mutually opposed, interspaced, oppositely directed connection means (7,8). Insertion of an attachment element in the space (20) and a (possibly forced) subsequent mutual twist of the suspension element (5) and the attachment element acieves a simple coupling between the suspension element and the attachment element. This coupling is very reliable and can be used very effectively for obtaining a secure suspension of a luminaire (1). Said secure suspension is particularly important in circumstances where the luminaire (1) is subjected to severe movements, e.g. at petrol stations or on ships. Said suspension element (5) may be made of metal, e.g. aluminum or steel, or synthetic resin, e.g. nylon reinforced with glass fibers.

14 Claims, 1 Drawing Sheet

SUSPENSION ELEMENT AND LUMINAIRE PROVIDED WITH A SUSPENSION ELEMENT

The invention relates to a suspension element comprising:

a base which is provided at one side with a first coupling means with a first retention bracket and a second coupling means with a second retention bracket;

which retention brackets are arranged on either side of a plane O which is perpendicular to the base.

The invention also relates to a luminaire.

Such a suspension element, which is provided on a luminaire, is known from WO 97/35416. The two retention brackets of the known suspension element are U-shaped and each have two limbs. Each retention bracket is situated with one limb in the base, while the other limb is at a distance from the base. The suspension element is designed for cooperating by means of its U-shaped retention brackets with a T-shaped rail which is, for example, fastened to the ceiling. For this purpose, the suspension element is moved with its U-shaped retention brackets around the two sides of the T-shaped rail through rotation of the base. The luminaire provided with the known suspension element can thus be suspended. It is furthermore envisaged with the known suspension element that the luminaire is freely displaceable over the T-shaped rail by sliding the suspension element over the T-shaped rail without any appreciable damage to the rail. It is a disadvantage of the known suspension element that a special profile is required for this, which has a comparatively precise fit with respect to the T-shaped rail.

The invention has for its object to counteract the above disadvantage. For this purpose, the suspension element of the kind described in the opening paragraph is characterized in that at least one retention bracket is concave and hook-shaped with respect to the base, and in that the retention brackets are connected to the base via a mechanical guiding element rising from the base for accommodating a fastening element, initially positioned between the retention brackets, in a space defined by the retention brackets by means of at least substantially frictionless displacements along the guiding elements. A series of displacements comprises, for example, a displacement of the fastening element and the suspension element towards one another in a direction along or in the plane O, a displacement at least partly in a direction transverse to the plane O of this fastening element, as a result of which a subsequent displacement of the fastening element and the suspension element away from one another in a direction along or in the plane O causes the fastening element to enter the space defined by the retention brackets. The suspension element is designed for cooperating by means of its retention brackets with the fastening element. No specific shape is required for the concave, hooked retention bracket if the suspension element is to function, so that a special profile of the fastening element is not required either. This means that in principle any rod and/or wire-shaped fastening element is suitable for cooperating with the suspension element according to the invention so as to achieve an interconnection of the suspension element and the fastening element. A wide variety of suitable embodiments of the suspension element is also made possible. Since an accurate dimensioning of the suspension element is not required, a manufacture of the suspension element is comparatively simple. In embodiments of the suspension element, the guiding element of the first retention bracket and the guiding element of the second retention bracket may be designed as separate guiding elements or as a joint guiding element. It was found with the use of a suspension element in which the mechanical guiding element of the first retention bracket is separate from the mechanical guiding element of the second retention bracket that an improved guidance of the displacement is obtained. A flexible suspension of the luminaire is also achieved with the suspension element, and a displacement over the fastening element can be easily carried out.

In an embodiment of the suspension element, the mechanical guiding element extends from the first retention bracket to the base and obliquely relative to the plane O up to or beyond the plane O, such that the fastening element is forced from the plane O by the guiding element during the displacement of the fastening element and the suspension element towards one another in a direction along or in the plane O. The word "obliquely" is understood to denote an angle of at most 45° between the guiding element and the plane O. Another disadvantage of the known suspension element is that it can comparatively easily get detached from the rail, for example during alignment of the luminaire fixed thereto, and may subsequently drop. This means that the known luminaire has a comparatively high risk of becoming damaged owing to dropping and/or of causing damage to its surroundings. In the suspension element according to the invention, the fastening element is brought between the retention brackets for coupling the suspension element and the fastening element, and subsequently is brought into a space defined by the retention brackets by means of a combination of mutual movements, preferably a combination of a rotary movement and translations about and along, respectively, an axis which is perpendicular to the base. It is immaterial for a cooperation between the suspension element and the fastening element whether it is the suspension element or the fastening element that performs the envisaged relative (rotary) movements for coupling. Decoupling of the suspension element and the fastening element requires movements of the suspension and fastening elements which are substantially inverse to the coupling movements. The risk that these inverse movements are inadvertently carried out is comparatively small, which achieves that the risk of the suspension element getting loose is considerably reduced, and is at least substantially smaller than the risk of the known suspension element getting loose. The suspension of a luminaire connected to the suspension element has thus become more reliable. It was found that the risk of an inadvertent detachment is smaller especially if a rotation is required for the undesirable movement. The suspension is made even more reliable thereby. The oblique design of the guiding element as it were automatically promotes the envisaged mutual rotation during the insertion of the fastening element into the space defined by the retention brackets and the subsequent movement towards one another of the fastening element and the suspension element. An additional advantage of a guiding element designed in this manner is that it counteracts any inadvertent decoupling of the fastening element and the suspension element in that it renders an undesirable, inverse mutual rotary movement more difficult. The suspension of the suspension element has been made even more reliable thereby.

In a further embodiment of the suspension element, the retention brackets each have a first end and a second, free end, said retention brackets being concave and hook-shaped with respect to the base, with the first retention bracket directed oppositely to the second retention bracket when traversing the relevant retention bracket from the first end to the free end. A shift towards and/or rotation relative to the free end by the fastening element, resulting in an inadvertent (partial) detachment of the suspension element, is counteracted thereby.

In a yet further embodiment of the suspension element, the projection of the free end and/or of the first end of the first retention bracket, in a perpendicular projection on the plane O, is situated on or between the projections of the free end and the first end of the second retention bracket. The introduction of the fastening element into the space defined by the retention brackets is made simpler thereby. It is also achieved that the curved portions lie substantially in one another's extended directions relative to the perpendicular on the plane O. This gives the suspension element the advantage that a shifting of the suspension element over the fastening element along the perpendicular to the plane O takes place comparatively smoothly, which promotes a simple positioning of the suspension element and an object coupled thereto.

In a favorable embodiment of the suspension element, the free end has an internally beveled side edge. The envisaged movement necessary for introducing the fastening element into the space defined by the retention brackets is facilitated thereby.

In a further embodiment of the suspension element, the projection of the first retention bracket coincides at least substantially with the projection of the second retention bracket in a perpendicular projection on the plane O. The introduction into the space defined by the retention brackets with some clearance is made easier thereby. It is also achieved that the retention brackets lie in one another's extended directions with respect to the perpendicular to the plane O. This gives the suspension element the advantage that shifting of the suspension element over the fastening element along the perpendicular to the plane O proceeds comparatively smoothly, which promotes a simple positioning of the suspension element and an object coupled thereto.

In another embodiment of the suspension element, the base is a flat plate, whereby a more stable suspension is achieved when subjected to forces in directions lying in the plane of the base of the object coupled to the suspension element. Preferably, the base is substantially circular, because this renders possible a comparatively good guiding of the suspension element during the envisaged rotary movement by means of a flange construction.

In a yet further favorable embodiment of the suspension element, the base is provided with an opening between the coupling means, through which opening the suspension element can be mounted in a simple manner to another object, for example a luminaire, for example by means of a screw passed through said opening. The opening may alternatively be used, for example, for the passage and resulting guidance of an electric cable which is used for electrically connecting the lamp to be accommodated in the luminaire. When the suspension element itself is used, it is possible to fasten the suspension element to a wall or ceiling via its opening in a simple manner, for example by means of a screw, in a permanently rotary manner.

Preferably, the suspension element is manufactured from metal or from synthetic resin. If the suspension element is made from metal, the suspension element may be manufactured in one piece by means of a stamping and bending process, for which a suitable material is, for example, steel plating. If the suspension element is made from synthetic resin, it may be manufactured in a comparatively simple manner in an injection molding process, for which a suitable material is, for example, PA-6, i.e. nylon-6 reinforced with 20% by weight of glass fiber.

The suspension element is preferably used in a luminaire comprising at least one suspension element as described above and further provided with means for accommodating an electric lamp in the housing. A reliable suspension of the luminaire is required especially in circumstances in which the luminaire is subject to violent movements, for example in outdoor applications such as a gas station or on a ship. Alternatively, the suspension element may be used to advantage for suspending other objects comprising a suspension attachment, which suspension attachment is to be introduced into the space defined by the curved portions of the retention brackets. Examples of applications with such objects are a curtain rod or a flexible guide for an electric cable along a wall and/or ceiling, with the suspension elements being fastened with rotation possibility to a wall or ceiling.

An embodiment of the luminaire according to the invention will be explained in more detail with reference to the diagrammatic drawing, in which.

Figure 1:
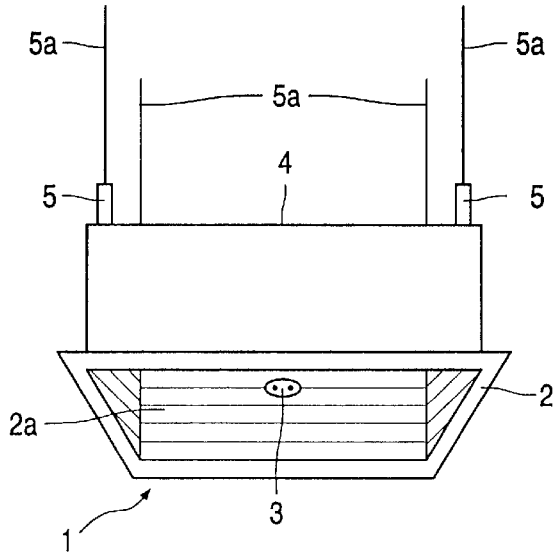
FIG. 1 shows a luminaire in perspective view.

In FIG. 1, a luminaire 1 has a housing 2 provided with a light emission window 2*a* and means 3 for accommodating an electric lamp (not shown) in the housing 2. In a side 4 of the housing 2 remote from the light emission window 2*a*, four suspension elements 5 are provided on the luminaire with rotation possibility with respect to the luminaire. The luminaire 1 is suspended to a ceiling (not shown) by its suspension elements via fastening elements 5*a*.

Figure 2:
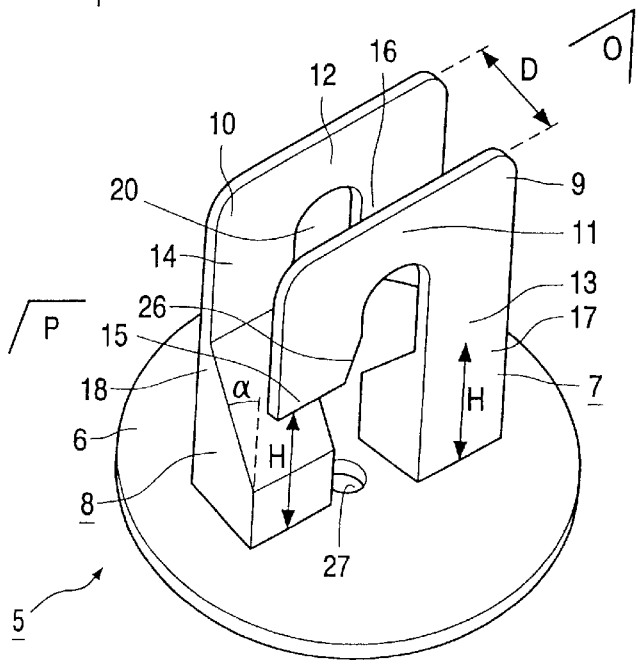
FIG. 2 shows a first embodiment of a suspension element according to the invention in perspective view.

In FIG. 2, the suspension element 5 has a base 6 lying in a plane P, which base is a circular, flat plate. A first 7 and a second coupling means 8 are arranged on the base 6 opposite one another with a mutual space D and extending in the direction of a plane O. The coupling means 7 and 8 are each U-shaped. Each coupling means 7, 8 has a respective retention bracket 9, 10 with a respective concavely curved portion 11, 12 having a respective first end 13, 14 and a respective free end 15, 16. No special profile of a fastening element (not shown) is required for accommodating said fastening element in a space 20 defined by the retention brackets. In principle, any rod-shaped and/or wire-shaped fastening element is suitable for cooperation so as to couple the suspension element 5 to the fastening element. The suspension element 5 need not have a special, accurately fitting profile, but a wide variety of suitable embodiments of the suspension element is made possible. The first end 13, 14 and the free end 15, 16 of each coupling means 7, 8 are at a shortest distance H from the plane B. The curved portion 11, 12 is connected by its respective first end 13, 14 to a guiding element 17, 18, by which guiding element 17, 18 the relevant coupling means 7, 8 is connected to the base 6. Each guiding element 17, 18 extends obliquely, at an angle $\alpha$ of 35° in the Figure, towards or beyond the plane O over a distance of between 0.5*D and D with respect to O. Going from the first end 13, 14 to the free end 15, 16 of the respective coupling means 7, 8, the curved portion 11 of the first coupling means 7 extends in a direction opposite to a direction in which the curved portion 12 of the second coupling means 8 extends. The curved portion 11, 12 is concave with respect to the base 6. The suspension element 5 is manufactured from a synthetic resin, in this case PA-6, i.e. nylon-6 with 20% by weight of glass fiber. The free end 15, 16 of the coupling means 7, 8 has an internally beveled side edge 26, and the base 6 is provided with an opening 27 centrally located between the guiding elements 17, 18.

Figure 3:
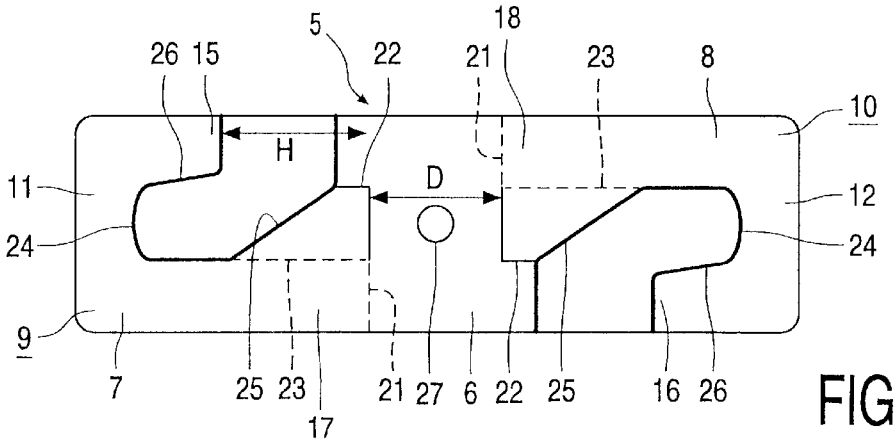
FIG. 3 shows a developed blank of a second embodiment of a suspension element according to the invention.

FIG. 3 shows a developed blank of a metal suspension element 5 according to the invention, for example manufactured from stainless steel, aluminum, or spring steel, which may be stamped from a metal plate of spring steel. The coupling means 7, 8 are formed in that they are stamped out along cutting lines 24 and subsequently bent about bending lines 21 so as to bring them in a position perpendicular to the base 6. The guiding element 17, 18 with an obliquely extending side 25 can be formed by means of additional cutting lines 22 and bending about the bending line 23. The free end 15, 16 of the coupling means 7, 8 has an internally beveled side edge 26 which facilitates the introduction of the fastening element into the space defined by the curved portions 11, 12 of the retention brackets 9, 10. The bending lines 21 of the respective coupling means 7, 8 are provided at a mutual distance D, which distance D is sufficient for receiving the fastening element with clearance between the two retention brackets 9, 10. After bending about the bending line 21, the free ends 15, 16 are at a shortest distance H from the base 6, which distance H is sufficient for bringing the fastening element (not shown) inside the curved portions 11, 12 of the coupling means 7, 8 through rotation. An opening 27 is provided centrally in the base 6. A suspension element manufactured from plating in accordance with the blank of FIG. 3 leads to comparatively how material losses.

What is claimed is:

1. A suspension element comprising:

a base which is provided at one side with a first coupling means with a first retention bracket front and rear longitudinal face and an edge connecting said front and rear longitudinal faces having a major axis and a second coupling means with a second retention bracket having a front and rear longitudinal face and an edge connecting said front and rear longitudinal faces having a major axis;

which retention brackets are arranged on either side of a plane O which is perpendicular to the base, said front longitudinal faces with major axes of said retention brackets being arranged proximal to each other and parallel to said plane O and on either side of said plane O and having a mutual distance D there-between sufficient for receiving a fastening element;

wherein at least one retention bracket is concave and hook-shaped with respect to the base, and in that the retention brackets are connected to the base via a mechanical guiding element rising from the base for accommodating a fastening element, initially positioned between the retention brackets, in a space defined by the retention brackets by means of at least substantially frictionless displacement along the guiding elements.

2. A suspension element as claimed in claim 1, wherein the displacements comprise:

a displacement of the fastening element and the suspension element towards one another in a direction along or in the plane O;

a displacement at least partly in a transverse direction with respect to the plane O of said fastening element, as a result of which a subsequent displacement of the fastening element and the suspension element away from one another in a direction along or in the plane O causes the fastening element or enter the space defined by the retention brackets.

3. A suspension element as claimed in claim 1, wherein the mechanical guiding element extends from the first retention bracket to the base and obliquely relative to the plane O up to or beyond the plane O, for forcing the fastening element from the plane O by the guiding element during the displacement of the fastening element and the suspension element towards one another in a direction along or in the plane O.

4. A suspension element as claimed in claim 2, wherein the displacement of the fastening element relative to the plane O comprises a rotation.

5. A suspension element as claimed in claim 1, wherein the mechanical guiding element of the first retention bracket is separate from the mechanical guiding element of the second retention bracket.

6. A suspension element as claimed in claim 1, wherein the retention brackets each have a first end and a second, free end, said retention brackets being concave and hook-shaped with respect to the base, with the first retention bracket directed oppositely to the second retention bracket.

7. A suspension element as claimed in claim 1, wherein the projection of the free end and/or of the first end of the retention bracket, in a perpendicular projection on the plane O, is situated on or between the projections of the free end and the first end of the second retention bracket.

8. A suspension element as claimed in claim 1, wherein the free end has an internally beveled side edge.

9. A suspension element as claimed in claim 1, wherein the projection of the first retention bracket coincides at least substantially with the projection of the second retention bracket in a perpendicular projection on the plane O.

10. A suspension element as claimed in claim 1, wherein the base comprises a flat plate.

11. A suspension element as claimed in claim 1, wherein the base is provided with an opening between the coupling means.

12. A suspension element as claimed in claim 1, wherein the suspension element is manufactured from metal or from synthetic resin.

13. A suspension element as claimed in claim 12, wherein the suspension element is manufactured in one piece from a plate material.

14. A luminaire comprising a housing provided with means for accommodating an electric lamp in said housing and comprising at least one suspension element as claimed in claim 1.

* * * * *